US005705475A

United States Patent [19]

Tang et al.

[11] Patent Number: 5,705,475

[45] Date of Patent: Jan. 6, 1998

[54] NON-FORMALDEHYDE DURABLE PRESS FINISHING FOR CELLULOSIC TEXTILES WITH PHOSPHONOALKYLPOLYCARBOXYLIC

[75] Inventors: Robert H. Tang, Murrysville; William A. Williams, Jr., Latrobe, both of Pa.

[73] Assignee: PPG Industries, Inc., Pittsburgh, Pa.

[21] Appl. No.: 586,048

[22] Filed: Jan. 16, 1996

Related U.S. Application Data

[60] Division of Ser. No. 247,943, May 24, 1994, Pat. No. 5,496,476, which is a continuation-in-part of Ser. No. 192,931, Feb. 7, 1994, abandoned, which is a continuation of Ser. No. 993,576, Dec. 21, 1992, abandoned.

[51] Int. Cl.[6] ..... D06M 13/192; D06M 13/288; D06M 15/263

[52] U.S. Cl. ..... 510/513

[58] Field of Search ..... 252/8.6, 174.16, 252/174.19, 174.24, 135, 8.61; 8/120, 127.1; 510/467, 476, 477, 513

[56] References Cited

U.S. PATENT DOCUMENTS

| | | | |
|---|---|---|---|
| 3,731,411 | 5/1973 | Barber et al. | 38/144 |
| 3,886,204 | 5/1975 | Geffers et al. . | |
| 4,563,284 | 1/1986 | Amjad | 210/699 |
| 4,579,676 | 4/1986 | Bull | 252/94 |
| 4,798,675 | 1/1989 | Lipinski et al. | 210/700 |
| 4,798,683 | 1/1989 | Boffardi et al. | 252/389.54 |
| 4,820,307 | 4/1989 | Welch et al. | 8/120 |
| 4,846,990 | 7/1989 | Upadek et al. | 252/8.8 |
| 4,913,823 | 4/1990 | Lipinski et al. | 210/699 |
| 4,931,063 | 6/1990 | Wilsberg et al. | 8/137 |
| 4,936,865 | 6/1990 | Welch et al. | 8/120 |
| 4,975,209 | 12/1990 | Welch et al. | 252/8.6 |
| 4,997,450 | 3/1991 | Olson et al. | 8/109 |
| 5,122,159 | 6/1992 | Olson et al. | 8/401 |
| 5,221,285 | 6/1993 | Andrews et al. | 8/127.1 |
| 5,259,985 | 11/1993 | Nakanishi et al. | 252/180 |
| 5,268,002 | 12/1993 | Olson et al. | 8/107 |
| 5,273,549 | 12/1993 | Didier et al. | 8/127.1 |
| 5,300,240 | 4/1994 | Wilhelm et al. | 252/8.6 |
| 5,324,477 | 6/1994 | Schrueder et al. | 422/37 |
| 5,352,242 | 10/1994 | Lammermann et al. | 8/120 |
| 5,370,708 | 12/1994 | Olson et al. | 8/108.1 |
| 5,427,587 | 6/1995 | Arkens et al. | 8/116.1 |

*Primary Examiner*—Paul Lieberman
*Assistant Examiner*—John R. Hardee
*Attorney, Agent, or Firm*—Irwin M. Stein

[57] ABSTRACT

A composition and method for providing a non-formaldehyde durable press finish to cellulosic fabrics by employing phosphonoalkylpolycarboxylic acids are disclosed. The phosphonoalkylpolycarboxylic acid is optimally used in combination with another polycarboxylic acid, such as polyacrylic acid, and/or, for cost effectiveness, a low-cost polycarboxylic acid such as citric acid. The catalyst for the curing reaction is optimally a phosphorus-containing acid or alkali metal salt thereof, such as a mixture of sodium monophosphate and sodium hypophosphite.

17 Claims, No Drawings

NON-FORMALDEHYDE DURABLE PRESS FINISHING FOR CELLULOSIC TEXTILES WITH PHOSPHONOALKYLPOLYCARBOXYLIC

This is a division of application Ser. No. 08/247,943 now U.S. Pat. No. 5,496,476, filed on May 24, 1994, which is a continuation-in-part of Serial No. 08/192,931 filed on Feb. 7, 1994, now abandoned, which is a continuation of Ser. No. 07/993,576 filed Dec. 21, 1992, now abandoned.

The present invention relates generally to the art of durable press finishing for cellulosic textiles and more particularly to the art of formaldehyde-free durable press finishing for cellulosic textiles.

Various commercial processes for imparting durable press properties to cellulose-containing fabrics use formaldehyde or formaldehyde derivatives together with acid catalysts to crosslink the cellulose of cotton fibers upon the application of heat. These durable press agents are effective and inexpensive, but produce undesirable results such as release of formaldehyde vapors, which are irritating if not dangerous, and loss of strength in the fabric due to degradation of cellulosics by acid cleavage of polymeric chains at high temperatures.

U.S. Pat. No. 3,526,048 to Rowland et al. describes crosslinking fibrous materials comprising cellulose by treating such materials with a polycarboxylic acid having various amounts of the carboxylic acid function neutralized with an alkali metal hydroxide, ammonium hydroxide or amine, and heating the treated cellulose to induce esterification and concurrent crosslinking. The polycarboxylic acid must contain no functional groups except carboxyl, and must contain at least three free carboxylic groups, each carboxyl group attached to a separate carbon atom, and at least two of the carboxyl groups separated by no more than one carbon atom.

A formaldehyde-free durable press finishing process is also described in U.S. Pat. No. 4,820,307 to Welch et al. In that process, fibrous cellulose in textile form is esterified and crosslinked by polycarboxylic acids such as butane-1,2,3,4-tetracarboxylic acid (BTCA) at elevated temperatures using catalysts which are acidic or weakly basic salts such as alkali metal dihydrogen phosphates and alkali metal salts of phosphorous, hypophosphorous and polyphosphoric acids.

U.S. Pat. No. 5,273,549 to Didier et al. discloses use as cellulose cross-linking agents of derivatives of alkanepolycarboxylic acids of the general formula

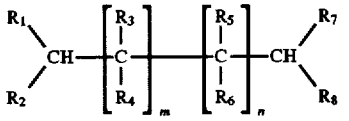

wherein m and n are zero or one, $R_1$, $R_3$, $R_5$ and $R_7$ are H or COOH, at least two being COOH, $R_2$, $R_4$, $R_6$ and $R_8$ are H or PO(OH)(OR) where R is H or $C_{1-4}$ alkyl, only one being PO(OH)(OR).

The present invention provides durable press fabric finishing without the generation of formaldehyde by means of a cellulose crosslinking system containing phosphonoalkylpolycarboxylic acid, a second polycarboxylic acid and a catalyst. The durable press finishing of the present invention provides durable press performance equal to that of dimethylol dihydroxy ethylene urea (DMDHEU) without the generation of formaldehyde during processing or release of formaldehyde from treated fabrics. Moreover, while fabrics treated in accordance with the present invention exhibit durable press performance equal to that of DMDHEU or BTCA, they also exhibit from about 10 to about 20 percent better retention of fabric strength.

The formaldehyde-free durable press crosslinking system of the present invention is preferably a mixture of phosphonoalkylpolycarboxylic acid and an esterification catalyst. The phosphonoalkylpolycarboxylic acid comprises an alkyl chain, preferably comprising from 3 to about 8 carbon atoms, at least one phosphono group attached to one of said carbon atoms, and at least two, preferably from 3 to 6, carboxyl groups, attached to said carbon atoms. Phosphonopropane polycarboxylic acids may be prepared by the reaction of 1,2,3,propane tricarboxylic acid with hypophosphorous acid or sodium hypophosphite. Phosphonoalkyl polycarboxylic acids of the formula

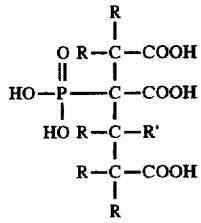

wherein R is hydrogen or lower alkyl and R' is hydrogen, lower alkyl or carboxyl are particularly useful in the formaldehyde-free durable press crosslinking system in accordance with the present invention. Various useful compounds are disclosed in U.S. Pat. No. 5,273,549. U.S. Pat. Nos. 3,886,204 and 3,886,205 describe the production of 2-phosphonobutane-1,2,3,4 -tetracarboxylic acids and 2 -phosphono-butane-1,2,4 -tricarboxylic acids respectively. Preferred phosphonoalkyl polycarboxylic acids include 2-phosphonobutane-1,2,4-tricarboxylic acid (PBTC) and phosphonosuccinic acid.

Esterification catalysts may include oxalic acid, phosphonic acids, organic phosphonates, alkali metal sulfides, paratoluene sulfonic acid, and acidic or weakly basic salts such as alkali metal dihydrogen phosphates and alkali metal salts of a phosporus-containing acid such as phosphorous acid, hypophosphorous acid and polyphosphoric acid. The alkali metal salts may include lithium, sodium and potassium salts. Ammonium salts may also be used. Most of the catalysts are weak bases, i.e. alkali metal salts of stronger acids than ortho-phosphoric acid. Preferred catalysts include alkali metal hypophosphites, phosphites and monophosphates, as well as phosphorous, hipophosphorous and pollphosphoric acids, and mixtures thereof.

Sodium hypophosphite and sodium monophosphate are preferred catalysts, particularly in combination. While any proportions of sodium monophosphate and sodium hypophosphite may be used, from 100 percent sodium monophosphate through a 50/50 mixture to 100 percent sodium hypophosphite, a preferred range of proportions is from 5:1 to 1:3 by weight of sodium monophosphate to sodium hypophosphite, each in the monohydrate form. Phosphorous acid is also a preferred catalyst.

The amount of catalyst used is that amount which is effective to catalyze the esterification reaction which crosslinks the cellulose, i.e. a catalytic amount. Generally, from 1 to 25 weight percent, e.g. 4 to 12 weight percent, of the catalyst based on the durable press composition may be useful. A ratio of 3:1 sodium monophosphate to sodium hypophosphite is preferred, particularly when the catalyst is used in the preferred range of 4 to 12 percent based on the weight of the durable press composition, i.e. the aqueous solution.

While phosphonoalkylpolycarboxylic acid alone may provide durable press properties, phosphonoalkylpolycarboxylic acid is employed in accordance with the present invention in combination with at least one other polycarboxylic acid. The second polycarboxylic acid may be an alkyl polycarboxylic such as BTCA, but is preferably a low molecular weight polyacrylic acid, e.g. with a weight average molecular weight less than 8000, preferably a molecular weight of 300 to 5000. A low molecular weight polyacrylic acid may be prepared by polymerizing acrylic acid by methods known in the art. Polyacrylic acids may include copolymers of acrylic acid and a comonomer, so long as durable press performance is not adversely affected. Suitable comonomers which contribute to the performance of the polyacrylic acid include unsaturated polycarboxylic acids, such as maleic acid. A particularly preferred polyacrylic acid is a polyphosphinoacrylic acid in the molecular weight range of 1500 to 5000, preferably 1500 to 3500, most preferably 3200 to 3500. Polyphosphinoacrylic acid is prepared by the reaction of acrylic acid and sodium hypophosphite in the presence of a free radical initiator.

The ratio of phosphonoalkylpolycarboxylic acid, e.g. phosphonobutane tricarboxylic acid, to polyacrylic acid, e.g. polyphosphinoacrylic acid, in the durable press composition is not critical. However, the durable press finishing performance of the phosphonoalkylpolycarboxylic acid is superior to that of the polyacrylic acid. Thus the proportion of phosphonoalkylpolycarboxylic acid is a cost/performance choice. Preferably, the durable press composition comprises at least 10 mole percent of the phosphonoalkylpolycarboxylic acid.

Even polyacrylic acids, particularly the preferred low molecular weight polyacrylic acids, and especially the more preferred low molecular weight polyphosphinoacrylic acids, are more expensive than hydroxypolycarboxylic acids such as citric acid. It may be useful therefore to include in the durable press compositions of the present invention a low cost durable press agent such as citric acid. This agent is not essential to performance, but is added to maintain performance at lower cost. Thus the proportion of hydroxypolycarboxylic acid is not critical. The amount added is limited primarily by the tendency of the hydroxypolycarboxylic acid to cause fabric discoloration. In general, it is preferred to use no more than 50 mole percent of a low cost hydroxypolycarboxylic acids as citric acid. Other polycarboxylic acids may be included in the durable press compositions of this invention. Examples of such potycarboxylic acids include maleic acid, citraconic acid, succinic acid, itaconic acid, 1,2,3-propane-tricarboxylic acid, trans-aconitic acid, butanetricarboxylic acid, butanetetracarboxylic acid, cyclopentanetetracarboxylic acid, mellitic acid, oxydisuccinic acid and thiodisuccinic acid.

Preferred durable press finish compositions of the present invention comprise phosphonoalkylpolycarboxylic acid in combination with both a polyacrylic acid, preferably a low molecular weight polyphosphinoacrylic acid, and a low cost hydroxypolycarboxylic acid, preferably citric acid. Such compositions preferably comprise at least 10 mole percent phosphonoalkylpolycarboxylic acid, no more than 50 mole percent hydroxypolycarboxylic acid and the balance polyacrylic acid, preferably 25 to 50 mole percent polyphosphinoacrylic acid. More preferred compositions comprise 10 to 50 mole percent phosphonoalkylpolycarboxylic acid, e.g. phosphonobutane tricarboxylic acid, 30 to 50 mole percent polyacrylic acid, e.g. polyphosphinoacrylic acid, and 10 to 40 mole percent hydroxypolycarboxylic acid, e.g. citric acid. Particularly preferred compositions comprise 35 to 40 mole percent 2-phosphonobutane-1,2,4-tricarboxylic acid, 40 to 50 mole percent polyphosphinoacrylic acid and 10 to 25 mole percent citric acid. Other polycarboxylic acids may be included, with the total of all polycarboxylic acid constituents adding up to 100 mole percent.

The compositions of the present inventions are prepared as concentrated aqueous solutions, typically 30 to 60 weight percent solids. Such a solution is generally diluted with water prior to use, thereby resulting in a final concentration of from about 1 to about 25 percent solids for application to the fabric. Concentrations from about 2 to 20 percent, particularly 5 to 15 percent are preferred.

The method of fabric treatment is generally to immerse the fabric in a bath of the composition and squeeze out the excess liquid by running the fabric through a pair of rollers. This typically results in a wet pick-up of about 80 to 100 weight percent. The fabric may be dried and cured in two steps, but is conventionally "flash-cured" in one step by heating at a sufficient temperature for a sufficient time to crosslink the cellulose fibers. Generally, temperatures between about 130° C. and 200° C. may be used. Typically, a temperature of from about 155° C. to about 185° C. for a period of from about 3 to about 10 minutes is sufficient. A preferred cure cycle for the compositions of the present invention is 170° C. to 175° C. for about 5 to 10 minutes.

The compositions and method of the present invention are applicable to cellulosic fibers in general, such as jute, ramie and linen. Natural cotton fabrics are effectively treated by the compositions and methods of the present invention. Blends of cotton and synthetic fibers such as polyester and polyamide may also be treated effectively. Cotton/polyester blends ranging from 20/80 to 80/20, particularly the common 50/50 and 65/35, are effectively treated in accordance with the present invention. Other cellulosic fibers and fabrics made therefrom, such as rayon and cellulose acetate, may also be treated in accordance with the present invention. Knit fabrics, as well as woven, cotton and cotton/polyamide blends for example, may be treated in accordance with the present invention.

Treated fabrics are evaluated for durable press performance by AATCC Test Method 124–1984, and given DP ratings from 1 to 5 based on their appearance. This procedure is designed to measure the relative effectiveness of durable press resins on cellulosic fabrics under conditions designed to simulate consumer care and usage. The fabric used is 100 percent cotton broadcloth, Style 419 from Testfabrics, Inc. Three pieces of cotton broadcloth, 12"×14" (30.5×35.6 centimeters), are cut for each composition to be tested. Each is soaked individually in test solution for at least 30 seconds and run through a two roll vertical pad at 1 bar pressure. The fabric is rewet and passed through the pad a second time. The wet weight minus dry weight is recorded as wet pick-up in percent based on dry weight. The treated fabric is mounted on pin frames and adjusted to 3 kilopascals tension, and cured in all of the examples herein at 175° C. for 5 minutes. After the fabric is dried and conditioned for 2 hours, it is rated initially by comparison against AATCC 3-D Durable Press Replicas. Samples are mounted such that the center of the samples and standards is 5 feet off the ground. Evaluation is in a darkened room with samples illuminated by an overhead fluorescent light. Observers are 4 feet away, and ratings by at least three observers are averaged, Thereafter, the fabric is washed and dried a total of 5 times using full ballast, 90 grams AATCC standard detergent 124, wash water at 120° F. (49° C.)±5°, rinse water at 85° F. (29.4° C.)±5° and normal washer and drier settings. After the last dry cycle, the fabric is removed and conditioned at least 2 hours before final rating. The DP ratings from 1 to 5 are described below.

DP-5 is a very smooth, pressed, finished appearance.

DP-4 is a smooth, finished appearance.

DP-3.5 is a fairly smooth but nonpressed appearance.

DP-3 is a mussed, nonpressed appearance.

DP-2 is a rumpled, obviously wrinkled appearance.

DP-1 is a crumpled, creased and severely wrinkled appearance.

Retention of fabric strength is evaluated by the Mullen Burst Test, and Mullen burst strengths are given in pounds per square inch. The Mullen Burst Test measures the force required to drive an air actuated piston through test material to determine relative material strength. The material to be tested is clamped in a ring holder. The piston is turned on and the pressure rises until failure occurs. The test is repeated four times at different points on the test material and the results are averaged.

The present invention will be further understood from the descriptions of examples of the present invention, as well as comparative examples of the prior art, which follow.

EXAMPLE 1

A solution was prepared by dissolving 18.4 grams of 50 weight percent aqueous solution of 2-phosphono-butane-1, 2,4 tricarboxylic acid (PBTC) and 10.9 grams of sodium hypophosphite monohydrate (SHP) in water to a total weight of 100 grams. A clear solution with a pH of 1.82 was obtained. Cotton fabric was treated with the solution to a wet pick-up of 90.7 percent. The treated fabric was cured at 175° C. for 5 minutes. The initial DP rating was 3.8. After five washes, the DP rating was 3.8. The fabric was subjected to the Mullen Burst Test, and its Mullen burst strength was 78.8 pounds per square inch.

EXAMPLE 2

A solution was prepared by dissolving 13.8 grams of 50 weight percent aqueous solution of PBTC and 8.1 grams of SHP in water to 94 grams. To this solution was added 6 grams of 43 weight percent aqueous solution of polyacrylic acid having a molecular weight of about 4700. The resulting solution was clear with a pH of 2.68. Cotton fabric was treated with the solution to a wet pick-up of 87.7 percent. The treated fabric was cured at 175° C. for 5 minutes. The initial DP rating was 3.5, as was the DP rating after five washes. The Multen burst strength was 88.5 pounds per square inch.

EXAMPLE 3

A solution was prepared by dissolving 18.4 grams of 50 weight percent aqueous solution of PBTC and 10.9 grams of SHP in water to 94 grams, and adding 6 grams of 43 weight percent aqueous solution of polyacrylic acid of molecular weight 4700 to form a clear solution with a pH of 2.3. Cotton fabric was treated to a wet pick-up of 91.7 percent and cured at 175° C. for 5 minutes. The initial DP rating was 3.5, and the DP rating after five washes was 3.7. The Mullen burst strength was 85.8 pounds per square inch.

EXAMPLE 4

A solution was prepared by dissolving 9.2 grams of 50 weight percent aqueous solution of PBTC, 24.3 grams of 30 weight percent aqueous solution of polyacrylic acid copolymer With acrylamide of molecular weight 1500 and 8.1 grams of SHP in water to 100 grams. The resulting solution had a pH of 2.4 and was cloudy. Cotton fabric was treated with this solution to a wet pick-up of 82.7 percent, and cured at 175° C. for 5 minutes. The initial DP rating and the DP rating after five washes were 3.8 and 3.7 respectively. The Mullen burst strength was 82.3 pounds per square inch.

EXAMPLE 5

A solution was prepared by dissolving 9.2 grams of 50 weight percent aqueous solution of PBTC, 14.6 grams of 50 weight percent aqueous solution of polyphosphinoacrylic acid of molecular weight 3300 and 8.1 grams of SHP in water to 100 grams. The resulting solution had a pH of 2.29 and was cloudy. Cotton fabric was treated with the solution to a wet pick-up of 85.0 percent, and cured at 175° C. for 5 minutes. The DP ratings were 3.5 and 3.2 for prewash and five washes respectively. The Mullen burst strength was 83.8 pounds per square inch.

EXAMPLE 6

A solution was prepared by dissolving 29.4 grams of 50 weight percent aqueous solution of polyphosphinoacrylic acid of molecular weight 3300 and 16.3 grams of SHP in water to 99 grams. This solution was diluted to 20 percent solids with water, and 13.4 grams of PBTC added, resulting in a cloudy solution with a pH of 2.70. Cotton fabric was treated with this solution to a wet pick-up of 86.8 percent, and cured at 175° C. for 5 minutes. The initial DP rating was 4.0 and the DP rating after five washes was 3.7. The Mullen burst strength was 82.8 pounds per square inch.

EXAMPLE 7

A solution was prepared by dissolving 6.9 grams of 50 weight percent aqueous solution of PBTC and 8.1 grams of SHP in water to 100 grams, providing a clear solution with a pH of 1.86. Cotton fabric was treated with this solution to a wet pick-up of 89.9 percent, and cured at 175° C. for 5 minutes. The initial DP rating was 3.2, and the DP rating after five washes was 3.0. The Mullen burst strength was 83.6 pounds per square inch.

EXAMPLE 8

A solution was prepared by dissolving 6.9 grams of 50 weight percent aqueous solution of PBTC, 4.2 grams of 40 weight percent aqueous solution of polyphosphinoacrylic acid (PPAA) and 8.1 grams of SHP in water to 100 grams. A clear solution with a pH of 1.72 was formed. Cotton fabric was treated with this solution to a wet pick-up of 95.4 percent, and cured at 175° C. for 5 minutes. The initial DP rating was 4.0, and the DP rating was 3.5 after five washes. The Mullen burst strength was 77.4 pounds per square inch.

EXAMPLE 9

A solution was prepared by dissolving 2.3 grams of 50 weight percent aqueous solution of PBTC, 2.5 grams of citric acid, 9.3 grams of 40 weight percent aqueous solution of polyphosphinoacrylic acid, 3 grams of sodium monophosphate monohydrate (SMP) and 1 gram of SHP in water to 100 grams. The resulting solution was clear with a pH of 2.5. Cotton fabric was treated with the solution to a wet pick-up of over 80 percent. The treated fabric was cured at 175° C. for 5 minutes. The initial DP rating was 3.5, and the DP rating was 3.5 after five wash-dry cycles. The Mullen burst strength was 80.8 pounds per square inch.

COMPARATIVE EXAMPLE A

A solution was prepared by dissolving 6.0 grams of dimethylol dihydroxy ethylene urea (DMDHEU) and 1.5 grams of magnesium chloride catalyst in water to 100 grams to form a clear solution with a pH of 3.9. Cotton fabric was treated with this solution to a wet pick-up of 87.2 percent, and cured at 175° C. for 5 minutes as in the previous examples. The initial DP rating was 3.5, and the DP rating after five waters was 3.3. The Mullen burst strength was 78.4 pounds per square inch.

COMPARATIVE EXAMPLE B

A solution was prepared by dissolving 6.0 grams of butane-1,2,3,4-tetracarboxylic acid (BTCA) and 8.1 grams of SHP in water to 100 grams to form clear yellow solution with a pH of 2.42. Cotton fabric was treated with this solution to a wet pick-up of 97.3 percent and cured at 175° C. for 5 minutes as in the previous examples. The initial DP rating was 3.5, and the DP rating was 3.5 after five washes. The Mullen burst strength was 77.6 pounds per square inch.

COMPARATIVE EXAMPLE C

A solution was prepared by dissolving 6.6 grams of anhydrous citric acid and 4.1 grams of SHP in water to 100 grams. The resulting solution was clear with a pH of 2.27. Cotton fabric was treated with the solution to a wet pick-up of 81.4 percent. The treated fabric was cured at 175° C. for 5 minutes. The initial DP rating was 3.0, and the DP rating was 2.7 after five wash-dry cycles. All samples were yellow beyond practical acceptability for this application. The Mullen burst strength was 87.4 pounds per square inch.

A summary of the DP ratings and Mullen burst strengths of Examples 1 to 9 of the present invention and Comparative Examples A to C are presented in the following table.

TABLE

| | | DP Ratings | | Burst |
|---|---|---|---|---|
| Example | DP Agent | Prewash | 5 Washes | (pounds/in$^2$) |
| 1 | PBTC | 3.8 | 3.8 | 78.8 |
| 2 | PBTC/PAA | 3.5 | 3.5 | 88.5 |
| 3 | PBTC/PAA | 3.5 | 3.7 | 85.8 |
| 4 | PBTC/PAA | 3.8 | 3.7 | 82.3 |
| 5 | PBTC/PPCA | 3.5 | 3.2 | 83.8 |
| 6 | PBTC/PPCA | 4.0 | 3.7 | 82.8 |
| 7 | PBTC | 3.2 | 3.0 | 83.6 |
| 8 | PBTC/PPAA | 4.0 | 3.5 | 77.4 |
| 9 | PBTC/PPAA/Citric | 3.5 | 3.5 | 80.8 |
| A | DMDHEU | 3.5 | 3.3 | 78.4 |
| B | BTCA | 3.5 | 3.5 | 77.6 |
| C | Citric (yellow) | 3.0 | 2.7 | 87.4 |

The above results illustrate the effectiveness of the compositions and methods of the present invention. Various fabrics may be treated with a range of components and concentrations and cured at other temperatures for different times without departing from the scope of this invention, which is defined by the following claims.

We claim:

1. A formaldehyde-free durable press finish composition for treating cellulose-containing fibrous materials consisting essentially of an aqueous solution of (i) 10 to 50 mole percent phosphonoalkylpolycarboxylic acid having at least one phosphono group, at least two carboxylic groups and wherein the alkyl group of said acid contains from 3 to 8 carbon atoms, (ii) 10 to 50 mole percent polyacrylic acid having a weight average molecular weight of less than 8000, and (iii) a catalytic amount of esterification catalyst, the sum of the polycarboxylic acids in said aqueous solution being 100 mole percent.

2. The composition of claim 1 wherein the esterification catalyst is selected from the group consisting of phosphorus-containing acids, alkali metal salts of phosphorus-containing acids and mixtures thereof.

3. The composition of claim 2 wherein the esterification catalyst is selected from the group consisting of sodium hypophosphite, sodium monophosphate and mixtures thereof.

4. The composition of claim 2 wherein the aqueous solution further comprises a hydroxypolycarboxylic acid, and wherein said hydroxypolycarboxylic acid represents not more than 50 mole percent of the polycarboxylic acids in said aqueous solution.

5. The composition of claim 4 wherein the aqueous solution comprises (a) from about 10 to about 50 mole percent of phosphonoalkylpolycarboxylic acid, (b) from about 10 to about 40 mole percent of hydroxypolycarboxylic acid, and (c) from about 30 to about 50 mole percent of polyacrylic acid, the sum of the polycarboxylic acids in said aqueous solution being 100 mole percent.

6. A formaldehyde-free durable press finish composition for treating cellulose-containing fibrous material consisting essentially of an aqueous solution of (i) 10 to 50 mole percent phosphonoalkylpolycarboxylic acid having at least one phosphono group, from 3 to 6 carboxylic groups and wherein the alkyl group of said acid contains from 3 to 8 carbon atoms, (ii) 10 to 50 mole percent polyacrylic acid having a weight average molecular weight of from about 300 to about 5000, and (iii) a catalytic amount of esterification catalyst, the sum of the polycarboxylic acids in said aqueous solution being 100 mole percent.

7. The composition of claim 6 wherein the esterification catalyst is selected from alkali metal hypophosphites, alkali metal phosphites, alkali metal monophosphates, phosphorous acid, hypophosphorous acid, polyphosphorous acid, and mixtures thereof.

8. The composition of claim 7 wherein the esterification catalyst is selected from sodium hypophosphite, sodium monophosphate and mixtures thereof.

9. The composition of claim 7 wherein the phosphonoalkylpolycarboxylic acid is phosphonobutanetricarboxylic acid, phosphonobutanetetracarboxylic acid or phosphonosuccinic acid, and the polyacrylic acid is polyphosphinoacrylic acid having a molecular weight of from about 1500 to about 5000.

10. The composition of claim 7 wherein the aqueous solution used to treat the cellulose-containing fibrous material further comprises a hydroxypolycarboxylic acid, and wherein said hydroxypolycarboxylic acid represents not more than 50 mole percent of the polycarboxylic acids in said solution.

11. The composition of claim 10 wherein the aqueous treating solution comprises (a) from about 10 to about 50 mole percent phosphonoalkylpolycarboxylic acid, (b) from about 10 to about 40 mole percent hydroxypolycarboxylic acid, and (c) from about 30 to about 50 mole percent of polyacrylic acid, the sum of the polycarboxylic acids in said aqueous solution being 100 mole percent.

12. The composition of claim 11 wherein the phosphonoalkylpolycarboxylic acid is phosphonobutanetricarboxylic acid, the hydroxypolycarboxylic acid is citric acid, and the polyacrylic acid is polyphosphinoacrylic acid having a molecular weight of from about 1500 to 5000.

13. The composition of claim 12 wherein the phosphonoalkylpolycarboxylic acid is 2-phosphonobutane-1,2,4-tricarboxylic acid and the polyphosphinoacrylic acid has a molecular weight of between about 1500 and about 3500.

14. The composition of claim 10 wherein the esterification catalyst is selected from the group consisting of sodium hypophosphite, sodium monophosphate and mixtures thereof.

15. The composition of claim 14 wherein the weight ratio of sodium monophosphate to sodium hypophosphite in said mixture is from about 5:1 to 1:3.

16. The composition of claim 13 wherein the esterification catalyst is selected form the group consisting of sodium hypophosphite, sodium monophosphate and mixtures thereof, the weight ratio of sodium monophosphate to sodium hypophosphite in said mixture being from about 5:1 to 1:3.

17. The composition of claim 16 wherein the aqueous treating solution has a solids concentration of from about 1 to about 25 weight percent.

* * * * *